US005201256A

United States Patent [19]

Schneider et al.

[11] Patent Number: 5,201,256

[45] Date of Patent: Apr. 13, 1993

[54] POWER TOOL FOR TORQUING THREADED PIPES

[75] Inventors: Irving N. Schneider, Woodbury; John A. Mattera, Rockville Centre, both of N.Y.

[73] Assignee: The Brooklyn Union Gas Company, Brooklyn, N.Y.

[21] Appl. No.: 863,816

[22] Filed: Apr. 6, 1992

[51] Int. Cl.[5] ..... B25B 13/50

[52] U.S. Cl. ..... 81/57.34; 81/57.39

[58] Field of Search ..... 81/57.34, 57.39

[56] References Cited

U.S. PATENT DOCUMENTS

| | | | |
|---|---|---|---|
| 4,027,560 | 6/1977 | Parker | 81/57.39 |
| 4,309,923 | 1/1982 | Wilmeth | 81/57.39 |
| 4,385,533 | 5/1983 | Collins | 81/57.39 |
| 4,406,185 | 9/1983 | Junkers | 81/57.39 |
| 4,432,256 | 2/1989 | Aparicio et al. | 81/57.39 |

*Primary Examiner*—James G. Smith

*Attorney, Agent, or Firm*—Paul W. Garbo

[57] ABSTRACT

A power tool for torquing a threaded member of a movable device, such as a pipe nipple of a gas meter sent for repairs, comprises a rigid disk with a bore to fit the nipple so that the disk can be placed against the meter, a block attached to the disk to prevent its movement, a reaction arm that cam be rotatably fitted on the nipple and locked to the disk, a torque arm that can be clamped on the nipple adjacent the reaction arm, and a hydraulic cylinder with its opposite ends connected to the reaction and torque arms to provide the force to move the torque arm.

12 Claims, 2 Drawing Sheets

POWER TOOL FOR TORQUING THREADED PIPES

BACKGROUND OF THE INVENTION

This invention relates to an apparatus for wrenching or torquing a threaded member of a movable device. More particularly, the wrenching apparatus is a power tool for loosening threaded nipples attached to meters.

Power tools to apply wrenching to threaded nuts and bolts have been disclosed in U.S. Pat. Nos. 3,955,447 and 4,027,560 to Parker and U.S. Pat. No. 3,706,244 to Wilmeth. These tools are used on devices that have a series of bolts and nuts; each tool uses one nut to provide the reaction force while wrenching is applied to another nut.

Wilmeth also shows in U.S. Pat. No. 4,309,923 a power tool for torquing a threaded connector mounted on a fixed pipe. In this case, the reaction force to the wrenching action on the connector is provided by a reaction foot that abuts the floor below the stationary pipe.

The prior art has not addressed the problem of loosening a threaded nipple from a meter after it has been disconnected for reconditioning and calibration. After years of service, the sealing compound used on the threads of the nipple sets so hard that it takes a torque in the range of 1000 to 2000 pound-feet to loosen a 3- or 4-inch nipple. Inasmuch as meters are made in different shapes and sizes, it is a difficult problem to hold the meter while such a large torque is applied to the nipple. A simple and practical structure for restraining meters of different configurations has not been found.

It is therefore a principal object of this invention to provide a wrenching tool that receives its reaction force solely from the device to which the threaded member is attached.

Another important object is to provide a power tool that is easily fitted to meters and nipples of different sizes.

Other features and advantages of the invention will be apparent from the description which follows.

SUMMARY OF THE INVENTION

In accordance with this invention, a power tool for loosening a threaded member of a movable device, such as a pipe nipple of a disconnected gas meter, comprises a rigid plate with an approximately centered bore so that the plate can be slipped over the nipple and placed against the meter, means attached to the rigid plate to engage or press against a part of the device, such as the flange at the top of the meter, a reaction arm with a hole at one end so that it can be slipped over the nipple and fastened to the rigid plate, a split-head wrench arm that can grip the nipple, and a hydraulic cylinder with its opposite ends connected to the reaction arm and wrench arm.

To make the tool of this invention usable on nipples of different diameters, the central hole in the rigid plate should be at least as large as the largest nipple that will be encountered. Bushings having bores of different diameters to slip on nipples of different diameters are provided to fit in the hole of the rigid plate and thus reduce the hole size to that of a specific nipple.

The plate or disk has a generally circular shape and is provided with a tangential extension on which a block can be mounted to act as the means that engages the device to provide the reaction force to the applied torque force. The flange at the top of a gas meter is a convenient and practical place where the block can establish the reaction point to a torque force. The rigid plate or disk also has a series of holes or perforations, equally spaced from one another along a circular line which is concentric with the central hole. The hole at one end of the reaction arm is dimensioned like the central hole of the rigid disk, i.e., it is at least as large as the largest nipple to be loosened and fits the bushings used with the rigid disk. The reaction arm has, intermediate its ends, a smaller hole that is aligned with the holes in the rigid plate when the reaction arm is slipped on the nipple and placed against the plate. A pin that fits this hole and any of the spaced holes in the plate is used to lock the reaction arm in different angular positions on the plate.

The wrench or torque arm grips the nipple and is rotatable counterclockwise while the reaction arm fastened to the disk by the pin cannot move because the block mounted on the disk is abutted against the flange at the top of the meter to prevent clockwise movement of the disk and reaction arm.

To apply the required force to the torque arm, a hydraulic cylinder is pivotally connected to the free ends of the reaction and torque arms. The distance between adjacent holes in the plate depends on the full distance traveled by the piston rod or plunger of the hydraulic cylinder. Thus, if each full extension of the piston rod causes the wrench arm to move away from the reaction arm by an additional angle of 15°, the holes in the rigid plate should be spaced from one another by substantially the same angle.

At the end of each stroke of the plunger of the hydraulic cylinder, the wrench arm has been moved to a new angular position. Thereupon, with the release of pressure on the hydraulic cylinder, the pin can be pulled out so that the reaction arm can be moved toward the wrench arm and thereby cause the piston rod to recede in the hydraulic cylinder. At this point, the pin can be inserted to lock the reaction arm to the plate at the hole adjacent the hole used by the pin before the wrench arm was partially rotated.

The hydraulic cylinder is again pressurized by hand pump or electrically driven pump to cause another angular displacement of the torque arm. At the completion of the stroke of the piston plunger, the pressure on the hydraulic cylinder is released and the reaction arm with the pin withdrawn is advanced toward the torque arm sufficiently to permit the pin to enter the hole in the plate next to the hole last used. By repeating these operational steps, the nipple not only is loosened from its cemented or frozen condition but also is rotated sufficiently so that it can then be easily removed from the meter with an ordinary wrench.

If the first and last holes in the series of holes in the rigid disk or plate are separated by an angle of at least 180°, it is rare that such an angular rotation of the nipple will not be adequate to permit the removal of the nipple with a simple wrench. In the rare case where a large torque is still required to rotate the nipple after the reaction arm has been locked to the disk at the last hole therein, the split head of the wrench arm is loosened so that it can be freely rotated clockwise back to the position it had when it was originally clamped on the nipple. Simultaneously, the reaction arm with the locking pin withdrawn is also rotated clockwise until the pin can enter the first hole or a hole near it in the series of holes in the disk. At this stage, the split head of the torque arm is again tightened to establish a firm grip on the nipple, and the repetitive operational steps are again performed until the nipple can be easily rotated counterclockwise with a simple wrench.

BRIEF DESCRIPTION OF THE DRAWINGS

For further clarification of the invention, the ensuing description will refer to the appended drawings of which.

DESCRIPTION OF PREFERRED EMBODIMENT

Figure 1:
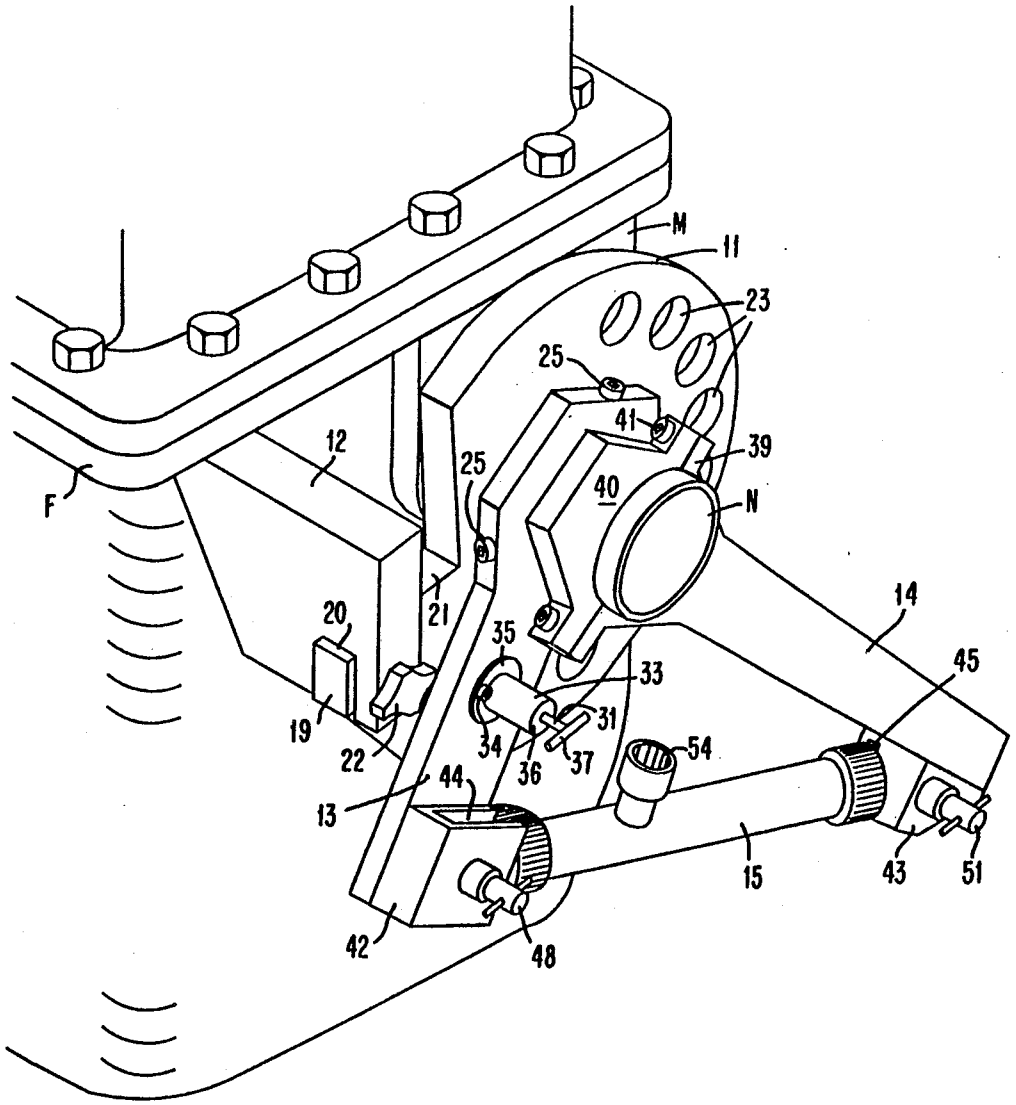
FIG. 1 is a front isometric view of the power tool of the invention for torquing and loosening a threaded nipple of a gas meter when mounted on the nipple.
Figure 2:
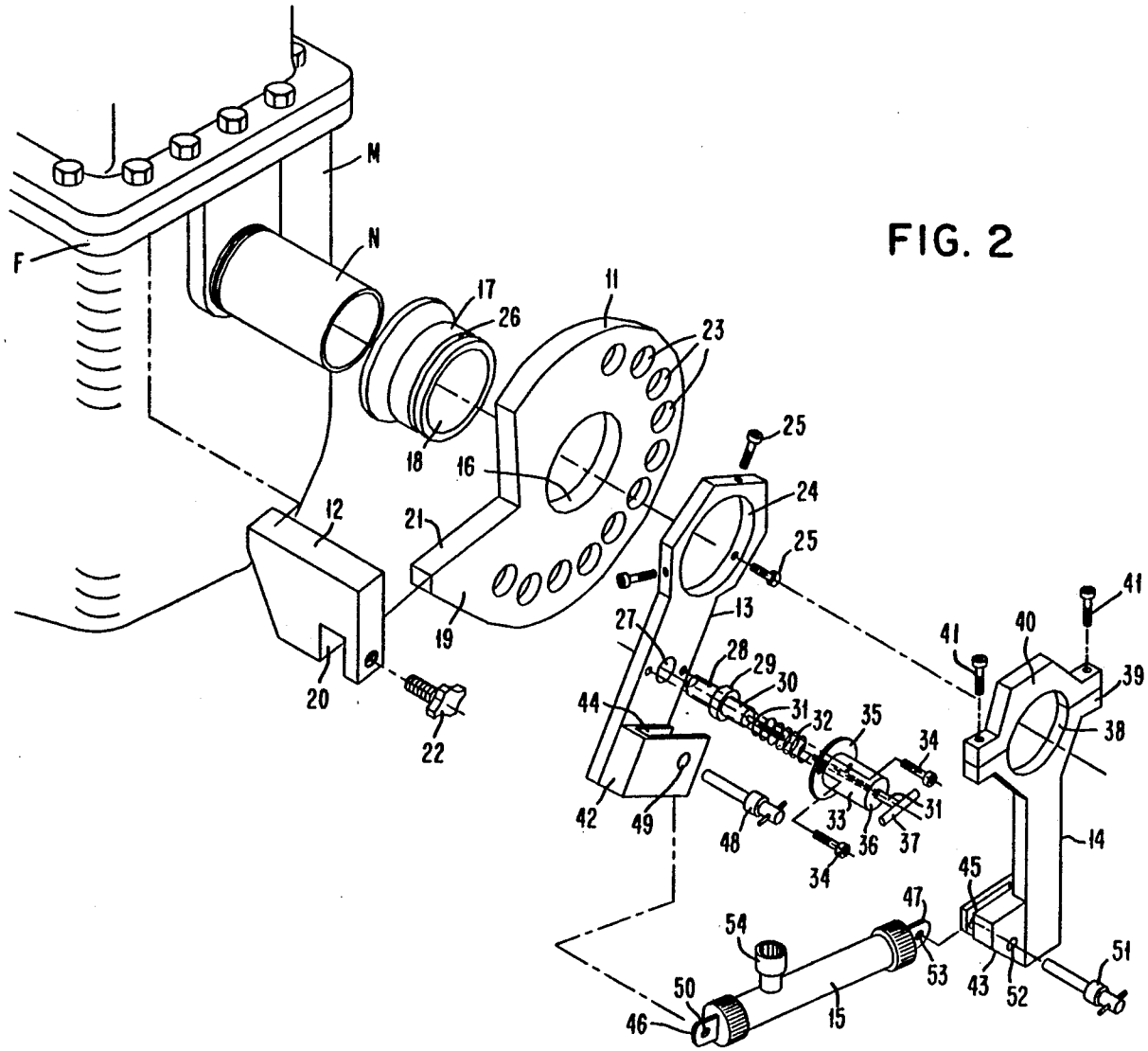
FIG. 2 is an exploded isometric view showing the parts of the tool of FIG. 1.

Referring to FIGS. 1 and 2, the wrenching tool 10 of the invention comprises five principal parts: perforated disk 11, reaction block 12, reaction lever or arm 13, wrenching or torque lever or arm 14 and hydraulic cylinder 15.

Disk 11 has a substantially centralized bore 16 large enough to slide over the nipple that is to be loosened from the gas meter. To make disk 11 adaptable for use with nipples of various sizes, it is preferred to make bore 16 large enough to fit the largest nipple that will be encountered and to provide a bushing 17 that fits into bore 16 and has a smaller bore 18. For example, bore 16 may fit a 4-inch nipple and bushing 17 can adapt disk 11 for a 3-inch nipple. Obviously, a bushing 17 can be provided for each other nipple size such as 2½- or 3½-inch nipple.

With bushing 17 fitted on nipple N so that it abuts meter M and with disk 11 fitted on bushing 17, reaction block 12 is mounted on tangential extension 19 by having slot 20 of block 12 straddle flat edge 21 of disk extension 19. The position of block 12 along the length of edge 21 is adjustable so that it can be positioned to make the best engagement with the bottom of flange F in the top portion of meter M. Bolt 22 can be turned by hand to lock block 12 in the desired position on disk 11.

Disk 11 has a series of perforations or holes 23 equally spaced from one another along a circular line (imaginary) that is concentric with bore 16. With disk 11 mounted on nipple N, reaction arm 13 with bore 24 is slipped over nipple N and fitted on bushing 17. Preferably, arm 13 has bolts 25 extending radially into bore 24 so that they can be turned down until their ends loosely fit in groove 26 encircling bushing 17. Thus, bolts 25 can positively position arm 13 adjacent disk 11 while permitting arm 13 to rotate freely on bushing 17.

Reaction arm 13 has a hole 27 spaced from bore 24 by the same distance between any hole 23 and bore 16 of disk 11. In other words, hole 27 which is of the same size as holes 23 overlies the circular series of holes 23 and can be positioned to coincide with any hole 23 so that a simple plug or pin can be inserted in hole 27 and a chosen hole 23 to keep arm 13 in an angularly fixed position relative to disk 11.

FIG. 2 shows an elaborate pin 28 with ring 29 and stem 30. The length of pin 28 is substantially equal to the combined width of disk 11 and arm 13. While stem 30 could provide the place for gripping pin 28 with the fingers to insert it in hole 27 and any hole 23 or to withdraw pin 28 therefrom, FIG. 2 shows a thin rod 31 axially connected to the free end of stem 30 and a compression spring 32 encircling rod 31. A cylindrical cap 33, large enough to permit ring 29 to slide therein as a piston would, is attached by screws 34 and flange 35 to arm 13. Rod 31 extends through a hole in end 36 of cylindrical cap 33 and terminates in grip 37. The length of cap 33 is sufficient to hold ring 29, stem 30 and compression spring 32 in its expanded state. When grip 37 is pulled with the fingers, spring 32 must contract enough for pin 28 to be pulled out of a hole 23 so that arm 13 can be rotated in order to insert pin 28 in another hole 23. When grip 37 is released, spring 32 will automatically push pin 28 into the selected hole 23.

With disk 11, reaction arm 13 and bushing 17 mounted on nipple N so that block 12 on disk 11 presses against the bottom of flange F of meter M, torque arm 14 is fastened directly on nipple N adjacent to reaction arm 13. Torque arm 14 has means at one end for clamping arm 14 tightly on nipple N. Such means, as shown in FIG. 2, comprises bore 38 formed between end 39 of arm 14 and yoke-like part 40 connected to end 39 by a pair of bolts 41. Bore 38 is so shaped and dimensioned that part 40 will not contact end 39 when placed around nipple N; therefore, bolts 41 can be tightened to clamp arm 14 firmly on nipple N.

The ends of arms 13,14 remote from bores 24,38, respectively, have offset hangers 42,43 for hydraulic cylinder 15. Hanger 42 on arm 13 has slot 44 on the side of arm 13 that faces arm 14, while hanger 43 on arm 14 has slot 45 on the side of arm 14 that faces arm 13. Thus, slots 44,45 are in the same plane even though arms 13,14 are in different planes. Hangers 42,43 are fastened to arms 13,14, respectively, in any desired way, such as by welding or with bolts.

The conventional hydraulic cylinder 15 has base clevis 46 and plunger clevis 47. Clevis 46 is pivotally held in slot 44 by pin 48 inserted through hole 49 in hanger 42 and through hole 50 of clevis 46. Similarly, clevis 47 is pivotally held in slot 45 by pin 51 inserted through hole 52 in hanger 43 and through hole 53 of clevis 47. Cylinder 15, which has threaded adapter 54 for connecting the hose of a hydraulic pump (not shown), operated manually or by electric motor, may be installed with base clevis 46 in hanger 43 and plunger clevis 47 in hanger 42.

With the tool of the invention fully assembled and mounted on nipple N of meter M as shown in FIG. 1, reaction arm 13 is swung clockwise and locked to disk 11 by inserting pin 28 into a hole 23, preferably hole 23 nearest extension 19 of disk 11. The length of cylinder 15 with its plunger fully retracted naturally sets the minimum angular distance of torque arm 14 from reaction arm 13. At this minimum angle, bolts 41 are tightened until yoke-like part 40 firmly clamps nipple N in bore 38 of torque arm 14. To ensure that there will be no slippage of arm 14 on nipple N when a large torque force is applied by arm 14, it is advisable to have serrations or like irregularities on the curved surfaces that form bore 38. As known, serrations and the like tend to dig into the surface of nipple N and thus provide a more positive grip on nipple N.

Having connected the hose of a hydraulic pump to adapter 54 of cylinder 15, hydraulic pressure is then applied until the plunger of cylinder 15 is fully extended. Inasmuch as the position of reaction arm 13 is immovable because arm 13 is locked to disk 11 by pin 28 inserted through holes 27, 23 and because clockwise rotation of disk 11 is prevented by block 12 abutted against the bottom of flange F of meter M, the extension of the plunger of cylinder 15 forces counterclockwise movement of torque arm 14 and nipple N. Holes 23 are spaced from one another by a distance commensurate to the distance traveled by the fully extended plunger of cylinder 15. Hence, by pulling pin 28 out of hole 23 and manually pushing arm 13 to cause the plunger of cylinder 15 to be fully retracted, arm 13 is again locked to disk 11 by inserting pin 28 in hole 23 to the right of hole 23 from which pin 28 was withdrawn. With each extension of the plunger of cylinder 15, torque arm 14 and nipple N are moved counterclockwise by several angular degrees equal to the angular degrees between consecutive holes 23. After each such extension, reaction arm 13 is advanced to the next hole 23 in the counterclockwise direction. In the rare case where having advanced reaction arm 13 to hole 23 farthest from extension 19 of disk 11 has failed to loosen nipple N completely, the tool can be reset on nipple N to continue its use until nipple N is satisfactorily unscrewed.

To reset the tool, bolts 41 are loosened so that arm 14, while pin 28 is out of hole 23, can be swung by hand clockwise until pin 28 can be inserted in hole 23 nearest extension 19 of disk 11. With arm 13 again locked to disk 11 in its original starting position and with arm 14 swung clockwise until the plunger of cylinder 15 is fully retracted, bolts 41 are tightened to again firmly clamp arm 14 on nipple N. The tool is now ready to continue the stepwise loosening and unscrewing of nipple N as has already been described.

It will be noted that bores 16 and 24 of disk 11 and reaction arm 13, respectively, have the same diameter to fit on bushing 17, but bore 38 of torque arm 14 has a smaller diameter to fit and grip nipple N. However, if tool 10 is required for loosening nipples of only one diameter, then bushing 17 can be elminated and bores 16, 24 and 38 of disk 11, reaction arm 13 and torque arm 14, respectively, can all have substantially the same diameter to fit that particular nipple. Where tool 10 is required for loosening nipples of various diameters, a different bushing 17 is required for each nipple size other than the largest nipple. Alternatively, bushing 17 may be used for the first step-down in nipple size, and a cylindrical liner or sleeve may be inserted between a still smaller nipple and bushing 17. For example, if bores 16,24 fit a 4-inch nipple, bushing 17 can be made to fit in bores 16,24 and on a 3½-inch nipple, and a sleeve can be slipped into the 3½-inch bore of bushing 17 and over a 3-inch nipple.

Because of the tremendous torque applied by arm 14 on nipple N and the need to clamp nipple N between yoke 40 and arm 14 so tightly that there is no slippage, it is generally advisable to provide for each nipple size an arm 14 with bore 38 and yoke 40 dimensioned to fit a specific nipple size. It is possible to reduce bore 38 of arm 14 by placing serrated semicylindrical fillers within bore 38 to grip a nipple smaller than bore 38 but this may not always prevent slippage of arm 14 on a smaller nipple.

Variations and modifications of the invention as illustrated herein will be apparent to those skilled in the art without departing from the spirit or scope of the invention. For instance, the means for restraining clockwise movement of disk 11, shown as block 12 mounted on extension 19 of disk 11, can be replaced by a large pin or bolt through extension 19 of sufficient length beyond the back of disk 11 to engage the bottom of flange F of meter M. Also, a simple cylindrical sleeve can be substituted for flanged bushing 17. While bolts 25 in reaction arm 13 and groove 26 in bushing 17 are desirable for holding arm 13 in position before torque arm 14 is clamped on nipple, bolts 25 and groove 26 can be eliminated because arm 13 will be kept in position against disk 11 as so on as arm 14 is clamped on nipple N. Other known forms of pipe clamping means for torque arm 14 can be used in lieu of yoke 40. Accordingly, only such limitations should be imposed on the invention as are set forth in the appended claims.

What is claimed is:

1. A power tool for torquing a threaded member of a movable device, which comprises:

a rigid disk with an approximately centered bore through which said threaded member fits, said disk having a tangential extension and a series of equally spaced perforations along a circular line concentric with said bore, restraining means attached to said tangenial extension of said disk for engaging a part of said movable device to prevent movement of said disk, a reaction arm with a bore at one end to fit on said threaded member and a hanger at the free end of said reaction arm, said reaction arm being positioned against said disk and having a locking hole that overlies and can coincide with any of said perforations in said disk, said reaction arm being provided with a locking pin that is insertable in said locking hole and any of said perforations to lock said reaction arm in a chosen angular position on said disk, a torque arm having clamping means at one end to firmly grip said threaded member and a hanger at the free end of said torque arm, said torque arm being positioned adjacent said reaction arm, and a hydraulic cylinder having a base clevis pivotally connected to one of said hangers and a plunger clevis pivotally connected to the other of said hangers.

2. The power tool of claim 1 wherein a bushing fits in the bores of the disk and the reaction arm and said bushing fits on the threaded member.

3. The power tool of claim 1 wherein the locking pin has a portion extending into a cap attached to the reaction arm and containing a compression spring, said portion having means for pulling it further into said cap against said compression spring.

4. The power tool of claim 1 wherein the restraining means is a block adjustably mounted on the tangential extension of the disk.

5. The power tool of claim 1 wherein the clamping means of the torque arm is provided by a bore formed between the end of said torque arm and a yoke-like part connected to said end by bolts, said bore being shaped to grip the threaded member.

6. The power tool of claim 5 wherein the restraining means is a block adjustably mounted on the tangential extension of the disk.

7. A power tool for unscrewing a pipe nipple from an unanchored gas meter, which comprises:

a rigid disk with a bore to receive said nipple, said disk having several equally spaced perforations along a circular line concentric with said bore, restraining means attached to said disk to engage a part of said meter and thus prevent movement of said disk, a reaction arm with a bore to receive said nipple, and with a hanger attached thereto and spaced from its bore, said reaction arm being positioned adjacent said disk and having a locking hole that overlies and can coincide with any of said perforations in said disk, said locking hole being provided with a locking pin therein that can be inserted into any of said perforations to lock said reaction arm in a chosen angular position on said disk, a torque arm with clamping means to grip said nipple firmly and with a hanger attached thereto spaced from said clamping means, and a hydraulic cylinder having a base clevis pivotally connected to one of said hangers and a plunger clevis pivotally connected to the other of said hangers, said hydraulic cylinder serving to force rotary movement of said torque arm.

8. The power tool of claim 7 wherein a bushing or cylindrical sleeve fits in the bores of the disk and the reaction arm, and fits on the nipple.

9. The power tool of claim 7 wherein the restraining means attached to the disk is a block with a slot that straddles a straight edge of said disk and is adjustably positioned on said edge.

10. The power tool of claim 9 wherein the clamping means of the torque arm is provided by a bore formed between the end of said torque arm and a yoke-like part connected to said end by bolts, said bore being shaped to grip the nipple.

11. The power tool of claim 10 wherein the locking pin has a portion extending into a cap that is attached to the reaction arm and contains a compression spring, said portion having a rod that is fastened thereto and extends out of said cap so that it can be manually pulled to withdraw said locking pin from a perforation in the disk.

12. The power tool of claim 7 wherein the clamping means of the torque arm is provided by a bore formed between the end of said torque arm and a yoke-like part connected to said end by bolts, said bore being shaped to grip the nipple.

* * * * *